US007625325B1

(12) United States Patent
Yost

(10) Patent No.: US 7,625,325 B1
(45) Date of Patent: Dec. 1, 2009

(54) EXERCISE CORD WALL MOUNT

(76) Inventor: Raymond Gerald Yost, 22 Forfar Cir., Bella Vista, AR (US) 72715

( * ) Notice: Subject to any disclaimer, the term of this patent is extended or adjusted under 35 U.S.C. 154(b) by 617 days.

(21) Appl. No.: 11/132,930

(22) Filed: May 19, 2005

(51) Int. Cl.
*A63B 21/02* (2006.01)

(52) U.S. Cl. ..... 482/129; 482/904

(58) Field of Classification Search ..... 482/121, 482/904, 126, 124; 248/693, 581, 300, 215, 248/301, 224, 269, 231.9, 220.22, 220.21, 248/315, 316.7; 24/701, 267, 666, 667, 115 R, 24/265 CD See application file for complete search history.

(56) References Cited

U.S. PATENT DOCUMENTS 677,014 A 6/1901 Buck
3,429,537 A * 2/1969 Jantzen ..... 410/116
3,477,104 A * 11/1969 Lewis ..... 24/611
5,431,617 A 7/1995 Rattray, Jr.
5,626,546 A 5/1997 Little
5,813,955 A * 9/1998 Gutkowski et al. ..... 482/124
6,258,011 B1 * 7/2001 Wolfe ..... 482/23
6,267,711 B1 7/2001 Hinds
6,319,179 B1 11/2001 Hinds

* cited by examiner

*Primary Examiner*—Jerome Donnelly
(74) *Attorney, Agent, or Firm*—Michael A. Mann; Nexsen Pruet, LLC

(57) ABSTRACT

A wall mount for use with exercise cords is secured to a wall and provides spring clips at multiple elevations for the attachment of the exercise cord. Each spring clip has a central curved portion that extends through a slot formed in the wall mount to provide an attachment point to which the exercise cords can be clipped with a caribiner. The wall mount is secured to the wall with a material-specific anchor. The cords may be quickly and easily attached and reattached to the spring clips at plural elevations for a large number of resistive exercise options.

14 Claims, 3 Drawing Sheets

EXERCISE CORD WALL MOUNT

CROSS REFERENCE TO RELATED PATENTS

Not applicable

BACKGROUND OF THE INVENTION

The present invention relates exercise equipment and more particularly to devices for securing exercise cords to walls.

There has been tremendous growth in the number of fitness facilities and gyms. Many of these facilities are elaborately equipped, with a full range of equipment for strength and aerobic exercising. These facilities satisfy the needs of adults who have the resources and desire to work out using the best equipment. The equipment at these facilities has improved as well, but is generally designed, sized and selected with the adult member in mind Not everyone has those resources for taking advantage of these facilities, and some have not perceived the need to work out. The elderly and the very young, in particular, may not be able to afford monthly dues at fitness facilities or be able to operate the adult-sized equipment safely. In addition, children need to develop a positive attitude toward exercise for exercise's sake at an early age.

The activity levels of children have tended to decline in recent years as a result of reduced time allocated for physical education and recess from many schools. There is also an increase in sedentary activities of children, such as watching television and playing with computer games, which compete with outdoor play time. In addition, the diet of children has worsened. Fats and sugars have increased in relation to complex carbohydrates and protein sources. As an inevitable result, the percentage of children who are overweight has tripled in the last twenty years.

Few schools have the resources—or the space—for a full line of fitness equipment, certainly not in the quantity needed for the school population. Furthermore, adult-sized fitness equipment would be of little use in the early grades because of biomechanics and complex adjustments.

Thus there remains a need for a way to introduce children in the younger grades to exercise, particularly resistance exercise, that is simple, inexpensive, requires minimal facilities space, and is safe for children to use and not likely to cause injury when not in use.

SUMMARY OF THE INVENTION

According to its major aspects and briefly recited, the present invention is a wall mount for exercise cords. The wall mount has a first side that is secured to the wall and provides spring clips at multiple elevations, each spring clip having a central curved portion that extends through a slot formed in the wall mount from the first side to an opposing second side for providing a site for the attachment of an exercise cord. The first side is anchored to a wall using expansion bolts or other material specific securement that provides proper anchoring. The cords may be quickly and easily attached and reattaached to the spring clips using caribiners. A large number of exercises can thus be done using exercise cords at different elevations. The cords come in various resistances to stretching so that smaller children or those who are deconditioned can use cords with less resistance and larger children or those with greater physical capacity can use cords with increased resistance.

An important feature of the present invention is the fact that it is anchored in the wall securely. Prior art wall mounts rely on screws or on pinching a strap or handle between a door and a doorframe. The present wall mount is fastened into masonry or studs by using material-specific anchors and bolts or equivalent providing additional security against coming loose.

The location of the securement sites of the wall mount proximate to the exercise cord attachment sites is another important feature of the present invention. This co-location puts less strain on the wall mount and relatively more on the securement when the exercise cords are pulled.

Another important feature of the present invention is the spring clips that are used for attaching the exercise cords. The central curves of these spring clips protrude from the rear of the mount and brace against the rear side of the wall mount when the exercise cord is pulled.

Still another important feature of the present invention is the shape of the wall mount. It is formed to have a low profile, with no sharp edges. The bolts that hold the wall unit to the anchors are recessed within the wall mount rim so that people brushing past the mounts are not exposed to the sharp edges of the bolts. The rings are protected on either side by a raise area forming shoulders on either side of the central portion of the spring clips so that clothing, for example, does not get caught on the spring clips.

Another feature of the present invention is the use of fixed elevations for the spring clips. Fixing the elevations, but allowing plural elevations, allows the user choices of elevations for different exercises. It also simplifies the construction and eliminates moving parts and maintenance.

These and other features and their advantages will be apparent to those skilled in the art of transmission line voltage measurement from a careful reading of the Detailed Description of Preferred Embodiments accompanied by the following drawings.

DETAILED DESCRIPTION OF THE INVENTION

The present invention is a wall mount for use with exercise cords. It is a system that includes the wall mount, the exercise cords and the hardware for attaching the exercise cord to the wall mount.

The term exercise cord is intended to include any flexible, resilient device with a major dimension much longer than its minor dimension and that increases resistance the farther it is stretched (up to its elastic limit). Exercise cords include tubes, cylinders and flat straps that are made of rubber, whether synthetic or natural, or other rubber-like material. The preferred prior art exercise cords are in the form of bungee cords with handles affixed to each end. They are available with different resistances to stretching and are often color coded to indicate the particular resistance level of each cord. Other types of exercise cords are commonly called rubber tubes.

Figure 1:
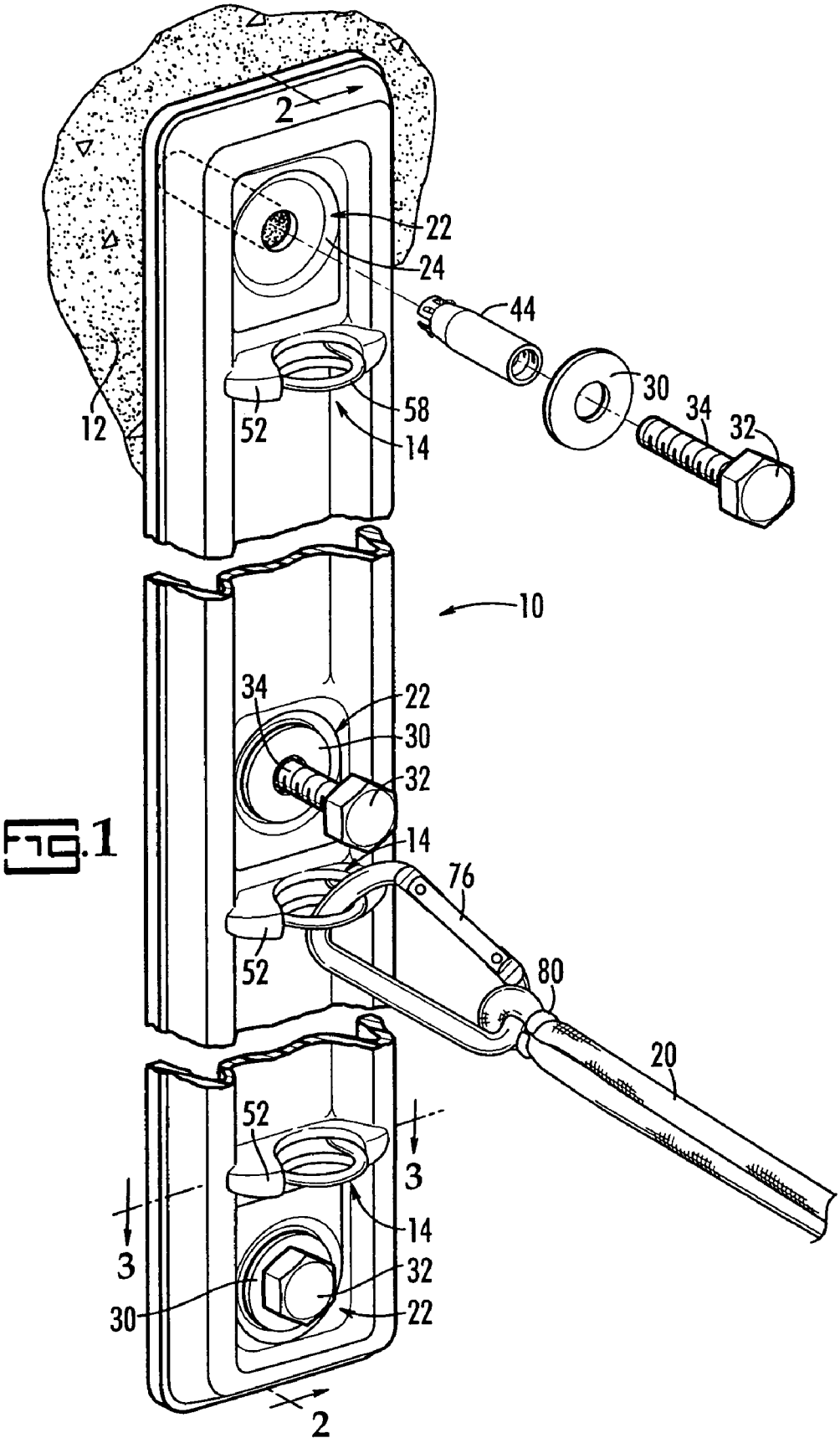
FIG. 1 is a perspective view of the wall mount according to a preferred embodiment.
Figure 2:
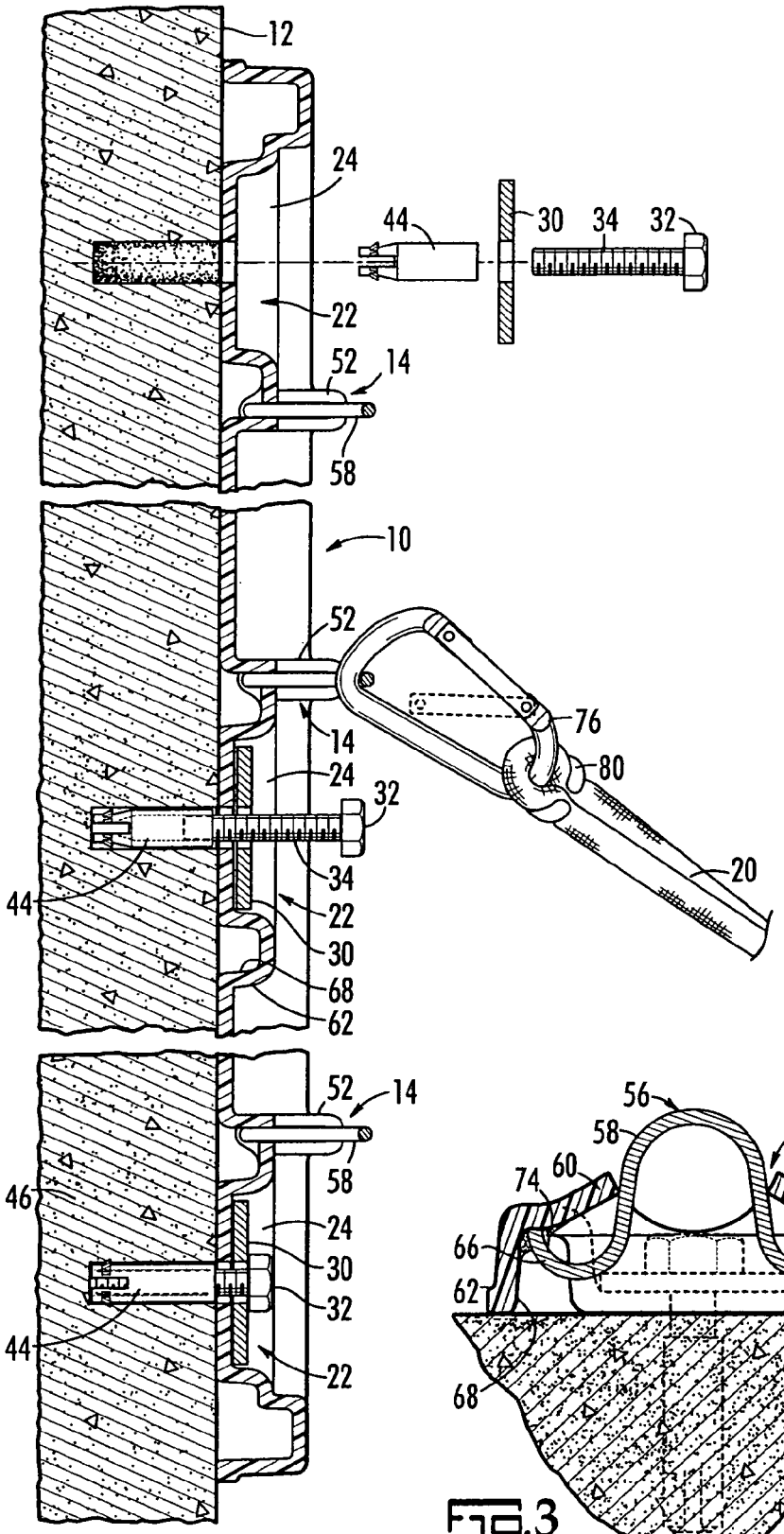
FIG. 2 is a cross sectional view of the wall mount of FIG. 1, taken along lines 2-2.
Figure 3:
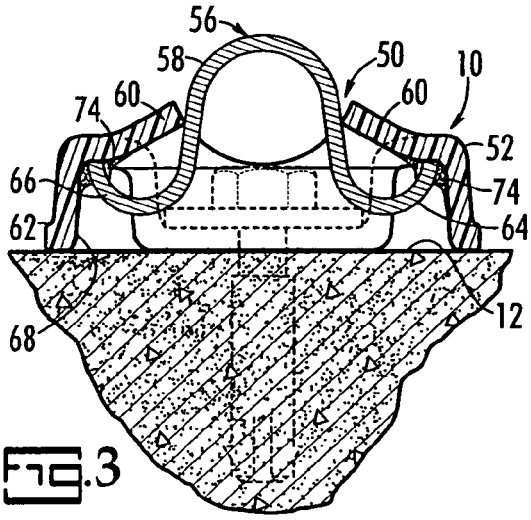
FIG. 3 is a cross sectional view of the wall mount of FIG. 1, taken along lines 3-3.

The prior art exercise cord is modified in the present invention for some exercises by combining it with a clip. To facilitate clipping the exercise cord to the wall mount, it is convenient to slip a caribiner over one end of the cord, center the caribiner between the ends of the exercise cord and then secure the caribiner in the centered location with a "hog ring," which is a short wire or wires bent around the bungee cord near the caribiner and crimped, thus holding the caribiner in position in the center of the bungee cord, as illustrated in FIGS. 1 and 2. The hog ring can be covered with tape or other wrap for a more finished appearance if desired.

A caribiner is a clip having a generally oval shape but being slightly wider at one end and having a pivoting gate along one side that opens only inwardly (see FIG. 1). Other clips that will allow the user to attach the exercise cord to a closed ring safely and securely would be equivalent.

Once the caribiner is attached to the exercise cord, it can be clipped to any one of the plural points of attachment provided by the wall mount.

Figure 4:
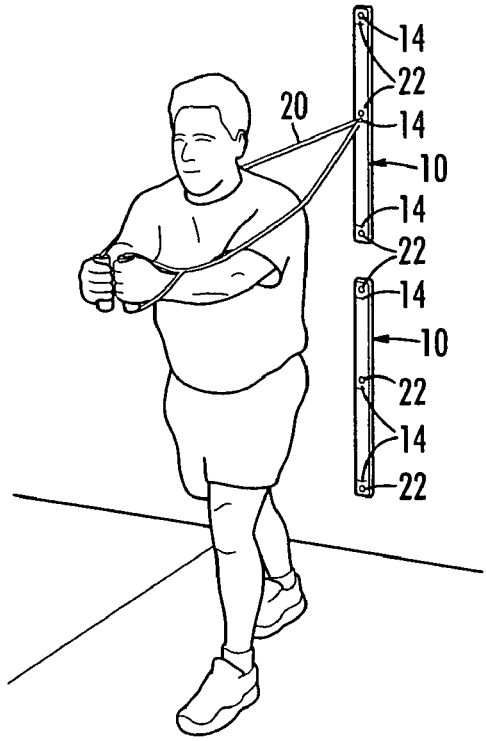
FIG. 4 and FIG. 5 illustrate two exercises that can be done with a wall mount according to a preferred embodiment of the present invention.
Figure 5:
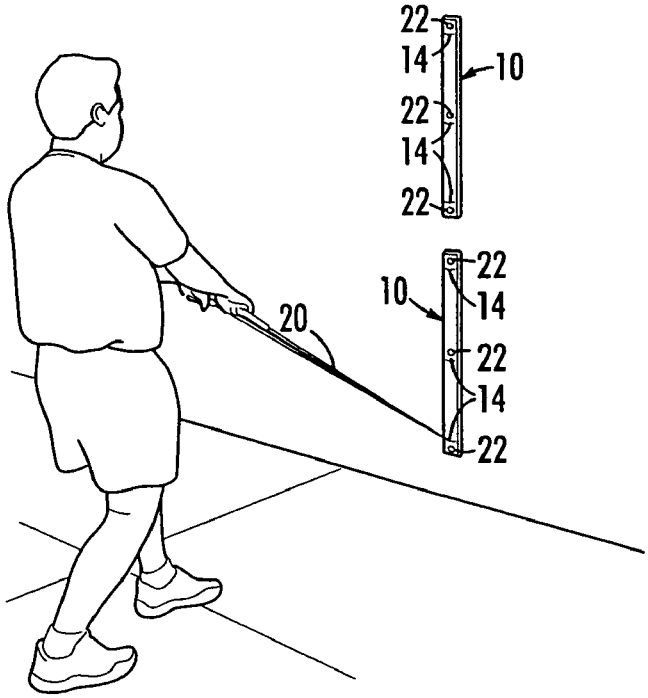

Referring now to FIGS. 1-5, a wall mount 10 according to the present invention preferably is formed in thirty inch lengths and may thus be mounted in pairs, spaced apart, arranged vertically (as shown in FIGS. 4 and 5) on a wall 12, to provide plural attachment sites 14 for an exercise cord 20. Wall mount 10 may be made of any strong, rigid material including metals and metal alloys such as aluminum and steel or of plastic or composite materials such as engineering grades of nylon and fiberglass-reinforced plastic or combinations thereof. Most preferably, it is injection-molded of plastic and formed to engage wall 12, that is, lying generally flat against wall 12.

Wall mount 10 has plural securement sites 22, preferably three, and plural exercise cord attachment sites 14, also preferably three, and most preferably with a securement site 22 proximate to each cord attachment site 14 so that the direction exercise cord 20 is being pulled is only slightly displaced from the direction of the tension provided by the securement to wall 12. Moreover, plural securement sites 14 help to assure that if one securement site 14 fails, other securement sites can continue to hold fast.

Each wall securement site 22 is formed to define a shallow circular recess 24 dimensioned to be deep enough to receive a washer 30 and the head 32 of a bolt 34, with both lying within recess 24 and not extending above a rim 38 of wall mount 10.

Wall mount 10 is attached to wall 12 using securements appropriate for the type of wall structure, material and the level of force the user expects to exert on exercise cords 20. Many schools, for example, use cinderblock or other masonry for interior and exterior support walls in gyms and in hallways. Therefore using bolts 34 and expansion bolts 44, as shown, or Molly bolts or other bolts that, when installed, apply an additional force against the direction of pull are preferred, whether that is by use of expansion bolts 44 that have teeth or increased frictional forces by exerting a greater normal force on masonry 46, or, for walls that have support studs should be used. Most preferably, the securement should provide additional security against coming loose from wall 12 than the threads of screws.

From the front of wall mount 10 (FIG. 1), exercise cord 20 attachment sites 14 appear to present a ring, insofar as a continuous portion of a wire appears extending through a slot 50 in a raised area 52 of wall mount 10. The "ring" is actually a central curve 56 in a triply curved stiff spring clip 58, preferably made of steel. Wall mount 10 in the vicinity of slots 50 is raised to form flanges or shoulders 60 on either side of central curve 56 to prevent clothing from snagging on spring clip 58.

The ends 64, 66 of spring clip 58 lateral to central curve 56 are curved in a direction that is the reverse of that of central curve 56 so as to engage first side 68 of wall mount 10, where they are glued in place and will press against first side 68 when a pulling force is exerted on central curve 58.

It is important that spring clip 58 not slip through slot 50 when subject to a pulling force. Several features combine to prevent this from happening. First, spring clip 58 is stiff and of heavy gage steel. Second, spring clip 58 is much longer than slot 50 is wide, being nearly as wide as the width of wall mount 10, and slot 50 is only as thick as the spring clip 58 to make it extremely difficult for lateral ends 64, 66, of spring clip 58 to be forced together directly or overlappingly to allow spring clip 58 to be pulled through slot 50 from first side 68 to a second side 62. Third, internal structure 70 of wall mount 10 adjacent to spring clip 58 and the adhesive 74 holding it in place prevent spring clip 58 from twisting.

The raised area 52 (with respect to wall 12 on which wall mount 10 is attached) surrounding spring clip 58, in addition to providing space for spring clip 58 itself, and protection against snagging of clothing, helps to hold spring clip 58 in place and in alignment. The exterior surface of wall mount 10, including rim 38, is curved elsewhere as well so as not to snag clothing or skin. Central curve 56 of spring clip 58 is the portion of wall mount 10 that extends farthest from wall 12.

Exercise cord 20 is attached to spring clips 58 using a caribiner 76 that is in turn secured in place to exercise cord using a hog ring or rings 80 to hold caribiner 76 in place, as described above.

Referring now to FIGS. 4 and 5, there are illustrated but two of many different exercises that are possible using the present wall mount 10 and exercise cord 20. FIG. 4 shows the user doing an exercise called a "high fly" at the midpoint of the exercise. Exercise cord 20 is attached at an upper attachment site 14.

FIG. 5 illustrates a user doing an exercise called a "low pull up" in the starting and finishing position. Exercise cord 20 is attached at a lower attachment site 14.

These and other exercises that can be done with the present system can improve strength, cardio-respiratory conditioning, flexibility, and muscle endurance.

It is intended that the scope of the present invention include all modifications that incorporate its principal design features, and that the scope and limitations of the present invention are to be determined by the scope of the appended claims and their equivalents. It also should be understood, therefore, that the inventive concepts herein described are interchangeable and/or they can be used together in still other permutations of the present invention, and that other modifications and substitutions will be apparent to those skilled in the art from the foregoing description of the preferred embodiments without departing from the spirit or scope of the present invention.

What is claimed is:

1. A device for use in exercising, said device comprising:

an exercise cord;

a wall mount having a first side and an opposing second side, and carrying an attachment site and a securement site, said attachment site having a slot and being adapted for attaching said exercise cord thereat, and said securement site being adapted for securing said first side of said wall mount to a wall; and a spring clip formed to have a central portion that extends through said slot of said attachment site from said first side to said second side so that said exercise cord on said second side of said wall mount can be attached to said central portion of said spring clip, and said spring clip braces against said first side of said wall mount when a pulling force is applied to said exercise cord attached at said second side of said wall mount to said central portion, wherein said spring clip has ends lateral to said central portion and glued to said first side of said wall mount.

2. The device as recited in claim 1, wherein said securement site is proximate to an attachment site.

3. The device as recited in claim 1, wherein said central portion is curved and said lateral ends are curved counter to said central portion.

4. The device as recited in claim 1, wherein said wall mount has a rim carried on said second side and said securement site is recessed in said wall mount with respect to said rim.

5. The device as recited in claim 1, wherein said wall mount has a raised area around said slot, said raised area defining shoulders on either side of said central portion of said spring clip.

6. A device for use in exercising, said device comprising:

an exercise cord;

a wall mount having a first side and an opposing second side and carrying an attachment site and a securement site, said attachment site having a slot and being adapted for attaching said exercise cord thereat; and a spring clip formed to have a central portion that extends through said slot of said attachment site from said first side of said wall mount to said second side so that said exercise cord on said second side can be attached to said central portion of said spring clip, and said spring clip braces against said first side of said wall mount when a pulling force is applied to said exercise cord on said second side of said wall mount, wherein said spring clip has lateral portions on either side of said central portion, said lateral portions having ends clued to said first side of said wall mount; and said securement site formed to facilitate securing said first side of said wall mount to a wall.

7. The device as recited in claim 6, wherein said securement site has a hole formed therein and adapted to receive an anchoring device.

8. The device as recited in claim 6, wherein said central portion of said spring clip has a first curve and lateral portions have a second curve counter to that of said central portion, and wherein said lateral portions brace against said first side when said pulling force is applied to said exercise cord.

9. A system for use in exercising, said device comprising:

an exercise cord;

a wall mount having a first side and an opposing second side, said wall mount carrying an attachment site and a securement site, said attachment site having a slot formed therein and being adapted for attaching said exercise cord thereat, and said securement site being adapted for securing said first side of said wall mount to a wall;

means for attaching said exercise cord to said second side of said wall mount at said attachment site; and a spring clip carried by said first side of said wall mount and formed to have a central portion that extends through said slot at said attachment site from said first side to said second side so that said attaching means can attach said exercise cord to said central portion of said spring clip, and said spring clip braces against said first side of said wall mount when a pulling force is applied to said exercise cord, wherein said spring clip has lateral ends curved counter to said central curve and wherein said lateral ends are clued to said first side.

10. The system as recited in claim 9, wherein said attaching means is a clip carried on said exercise cord.

11. The system as recited in claim 10, wherein said clip is a caribiner.

12. The system as recited in claim 9, wherein said wall mount has a rim.

13. The system as recited in claim 12, wherein said securement site is recessed with respect to said rim.

14. The system as recited in claim 13, wherein said securement site has a hole formed therein to receive a bolt.

* * * * *